US008278617B2

(12) United States Patent
Garfinkle et al.

(10) Patent No.: US 8,278,617 B2
(45) Date of Patent: Oct. 2, 2012

(54) CARGO SHIPMENT SECURITY ENCLOSURE, METHOD, SYSTEM, AND METHOD OF MAKING

(75) Inventors: Jeffrey J. Garfinkle, New York, NY (US); John P. Lock, Wakefield, MA (US)

(73) Assignee: Sentina, Inc., Cambridge, MA (US)

( * ) Notice: Subject to any disclaimer, the term of this patent is extended or adjusted under 35 U.S.C. 154(b) by 3 days.

(21) Appl. No.: 13/083,189

(22) Filed: Apr. 8, 2011

(65) Prior Publication Data

US 2011/0253887 A1 Oct. 20, 2011

Related U.S. Application Data

(60) Provisional application No. 61/322,391, filed on Apr. 9, 2010.

(51) Int. Cl.
*G01N 1/24* (2006.01)
*G01N 35/10* (2006.01)
*H05H 3/00* (2006.01)

(52) U.S. Cl. ..... 250/251; 250/288; 250/281; 250/282; 73/31.02; 73/31.03; 73/31.05; 73/700; 73/863

(58) Field of Classification Search ..... 250/288, 250/281, 282, 251; 73/31.02, 31.03, 31.05, 73/700, 863
See application file for complete search history.

(56) References Cited

U.S. PATENT DOCUMENTS

| | | | | |
|---|---|---|---|---|
| 7,100,424 | B2 * | 9/2006 | Wilson | 73/31.05 |
| 7,188,513 | B2 * | 3/2007 | Wilson | 73/31.05 |
| 2010/0090097 | A1 * | 4/2010 | Koltick | 250/251 |
| 2010/0294925 | A1 * | 11/2010 | Musselman | 250/282 |

* cited by examiner

*Primary Examiner* — Nikita Wells
(74) *Attorney, Agent, or Firm* — Morse, Barnes-Brown & Pendleton, P.C.; Sean D. Detweiler, Esq.

(57) ABSTRACT

A cargo shipment security system includes a flexible body configured to completely enclose and contain cargo within an internal environment having a predetermined pressure. The system includes a sealable vacuum port disposed on and through the body and configured to couple with a vacuum source for creating a vacuum within the internal environment. The system includes one or more sealable ports disposed on and through the body, positioned to cause a turbulent flow through a predetermined volume of the internal environment of the body when the vacuum source is applied at the vacuum port and fluid is caused to enter the internal environment. The system includes one or more detectors positioned to intercept fluid flowing from the internal environment to an external environment outside the body, in such a way as to enable detection of the presence of a substance exiting from the internal environment.

31 Claims, 13 Drawing Sheets

CARGO SHIPMENT SECURITY ENCLOSURE, METHOD, SYSTEM, AND METHOD OF MAKING

RELATED APPLICATIONS

This application claims priority to, and the benefit of, U.S. Provisional Patent Application No. 61/322,391, entitled "Protective, Tamper-Evident Enclosure" and filed Apr. 9, 2010. The entire contents and disclosure of the referenced application are incorporated by reference herein.

FIELD OF THE INVENTION

The present invention relates to security enclosures for securing and protecting various contents, and, more particularly, to security methods, systems, and apparatuses for detecting and/or monitoring attempted intrusion, damage, tampering with, or otherwise altering of contents enclosed therein.

BACKGROUND OF THE INVENTION

Tampering and theft of valuables and/or goods while in storage or transit is a problem for many industries and forms of transportation. Whether transported by land, air, or sea, vulnerability to theft as well as tampering by smugglers, terrorists, and stowaways is a persistent concern for shipment providers, customers of such providers, recipients of shipments, and others involved in such processes. Historically, cargo shipments have been particularly attractive targets for such tampering activities, thus placing them at greater risk of intrusion or compromise.

To adequately address these risks, cargo security measures must simultaneously provide solutions that are reliable, cost-effective, and easy-to-use, in order to achieve mandated security levels without impeding legitimate trade and commerce. This is a highly challenging prospect considering the sheer volume of cargo to be screened and secured and the sheer size of containers and/or shipments to be transported. In 2007, 3.8 million tons of cargo was transported on U.S. passenger flights. 56% of this cargo was transported domestically and 44% was transported on flights to the United States. In fiscal year 2008, the number of cargo containers imported to the U.S. was 9.8 million.

The challenges upon cargo security are further exacerbated by the complexity of the network that is involved in the transportation of cargo. Many different participants, handlers, and points of transfer are involved from start to finish. For example, taking cargo from a warehouse to a port/airport to a plane to a delivery truck to a final location may involve handling by the respective employees of four or five different businesses. Often, cargo is first transported to consolidators that combine shipments onto pallets, which are then packed into cargo containers or onto unitized load devices (ULDs) for aircraft. The containers and ULDs are then transferred to the actual carriers, who may deliver the cargo directly to its destination port or airport, or route it through one or more connections. At each point in this supply chain, the cargo is potentially vulnerable to tampering and theft.

One attempt to provide a cost-effective security system is the use of non-intrusive imaging (NII) technology that utilizes gamma radiation to screen cargo containers at several ports. However, radiation technology tends to create discomfort among operators of the equipment and drivers who are needed to pull the containers through the devices, given the potential and perceived health hazards associated with radiation exposure. Furthermore, for air cargo in particular, the expense and size of the X-ray or computed tomography (CT) equipment capable of scanning ULDs is cost prohibitive. ULDs can have dimensions of about 96"×125"×64", or even as large as about 96"×238"×96". Scanning devices capable of screening shipments this large are extremely expensive.

One attempt to provide a more affordable solution for cargo security has been to screen pallets and packages sent by shippers prior to consolidation, and then secure the container or ULD in a way that guarantees detection of any intrusions or attempts to tamper with the cargo in order to add illicit materials or remove merchandise. Especially for containers, numerous technologies exist for securing the container door(s) and monitoring the conditions within the container, including light intensity, temperature, pressure, humidity, and even magnetic flux, for indications of intrusion. Many of these technologies also include wireless networking capabilities for communicating status updates of the cargo and locking devices and for alerting personnel to any detected hazards in the container or opening of the door.

For air cargo ULDs, which are sometimes enclosed only by a plastic wrap (e.g., "pallet wraps"), fewer solutions have been proposed. Some ULD wraps with tamper-evident locking zippers have been developed. However, such current cargo security technologies lack the ability to sufficiently and simultaneously address tamper-detection reliability, affordability, and ease-of-use.

Alternatively, some attempts have involved rapidly producing a vacuum that is sufficient to vaporize particular substances disposed within the internal chamber of a container to be shipped prior to sealing the container. Such systems typically can require high volume vacuum pumps and other expensive equipment. Additionally, vaporization pressures vary from substance to substance, thereby limiting the types of particulates that will be detected as a result of the applied vacuum. If such systems are intended to be used for a broader range of substance detection, calibration may be required prior to applying the vacuum so as to select a particular substance or group of substances that will be vaporized by the vacuum.

An additional drawback of such systems is that the vaporization pressure of many substances is extremely low, e.g., on the order of $10^{-7}$ mm Hg. Requiring a vacuum on this order of magnitude can impose extremely strict limits upon the suitable materials, etc. for constructing containers capable of enclosing such vacuums. Additionally, vacuums on this order of magnitude can cause substantial harm to the contents being tested, thereby producing additional required packaging for the contents being tested prior to conducting the detection tests. Systems and methods constrained by such pressure requirements either impose strict packaging requirements to endure the extremely low vacuum conditions, or are associated with impractically long wait times for vaporization to occur at less extreme vacuum pressures. Additionally, high volume pumps sufficient for pumping large volumes to these pressures are also cost-prohibitive given the quantity of goods that must be screened and shipped daily.

SUMMARY

There is a need for a reliable, affordable, easy-to-use system for providing tamper detection and other related security features. Embodiments of the present invention are directed toward further solutions to address these and other needs, in addition to having other desirable characteristics which will be appreciated by one skilled in the art upon reading the present specification.

In accordance with embodiments of the present invention, a cargo shipment security system can include a flexible body configured to completely enclose and contain cargo within an internal environment and maintain a predetermined pressure within the internal environment. A sealable vacuum port can be disposed on and through the body and can be configured to couple with a vacuum source for creating a vacuum within the internal environment. One or more sealable ports can be disposed on and through the body, and can be positioned to cause a turbulent flow through a predetermined volume of the internal environment of the body when the vacuum source is applied at the vacuum port and when fluid is caused to enter the internal environment through the one or more sealable ports. One or more substance detectors, one or more substance collectors, or both can be positioned to intercept fluid flowing from the internal environment to an external environment outside the body, in such a way as to enable detection of the presence of a substance exiting from the internal environment. The turbulent flow can be sufficient to dislodge at least a trace amount of the substance.

In accordance with embodiments of the present invention, the predetermined pressure can be a predetermined absolute pressure that is not equal to a pressure of the external environment. The predetermined pressure can be a predetermined differential pressure with respect to the external environment. The one or more substance detectors, one or more substance collectors, or both, can comprise a substance collector, and the system can further include an ion mobility spectrometer device. The predetermined pressure can be a pressure of at least about 50 mm Hg less than a lowest expected atmospheric pressure to be encountered during an instance of vulnerability to tampering, theft, or damage once prepared for conveyance or while in transit. The predetermined pressure can be a pressure of about 500 mm Hg or less. The vacuum port and the one or more sealable ports can be configured to be reopened and resealed, thereby enabling one or more detection tests to be performed on a single cargo shipment. The body can further comprise an airtight zipper for enclosing and sealing the cargo. The body can comprise one or more materials that are impermeable to a gas, a liquid, or both. The body can comprise a single continuous piece of material. The body can comprise two or more pieces of material coupled together.

In accordance with embodiments of the present invention, a method of manufacturing a cargo shipment security system can include providing a flexible body configured to completely enclose and contain cargo within an internal environment and maintain a predetermined pressure within the internal environment. A sealable vacuum port can be provided that is disposed on and through the body and configured to couple with a vacuum source for creating a vacuum within the internal environment. One or more sealable ports can be provided that are disposed on and through the body and that are positioned to cause a turbulent flow through a predetermined volume of the internal environment of the body when the vacuum source is applied at the vacuum port and fluid is caused to enter the internal environment through the one or more sealable ports. One or more substance detectors, one or more substance collectors, or both, can be provided that are configured to intercept fluid flowing from the internal environment to an external environment outside the body, in such a way as to enable detection of the presence of a substance exiting from the internal environment. The turbulent flow can be sufficient to dislodge at least a trace amount of the substance.

In accordance with embodiments of the present invention, the predetermined pressure can be a predetermined absolute pressure that is not equal to a pressure of the external environment. The predetermined pressure can be a predetermined differential pressure with respect to the external environment. The one or more substance detectors, one or more substance collectors, or both, can comprise a substance collector. An ion mobility spectrometer device can be provided. The predetermined pressure can be a pressure of at least about 50 mm Hg less than a lowest expected atmospheric pressure to be encountered during an instance of vulnerability to tampering, theft, or damage once prepared for conveyance or while in transit. The predetermined pressure can be a pressure of about 500 mm Hg or less. The vacuum port and the one or more sealable ports can be configured to be reopened and resealed, thereby enabling one or more detection tests to be performed on a single cargo shipment. The body can further comprise an airtight zipper for enclosing and sealing the cargo. The body can comprise one or more materials that are impermeable to a gas, a liquid, or both (i.e., a fluid). The body can comprise a single continuous piece of material. The body can comprise two or more pieces of material coupled together.

In accordance with embodiments of the present invention, a cargo shipment security method can include completely enclosing cargo within an internal environment of an apparatus. The apparatus can comprise a flexible body having a sealable vacuum port and one or more sealable ports. A vacuum source can be applied at the vacuum port, thereby causing fluid to enter the internal environment through the one or more sealable ports and causing turbulent flow through a predetermined volume of the internal environment. One or more substance detectors, one or more substance collectors, or both, can be provided, and can be positioned to intercept fluid flowing from the internal environment to an external environment that is outside of the body, in such a way as to enable detection of the presence of a substance exiting from the internal environment.

The one or more sealable ports can be sealed. The vacuum source can be removed and the vacuum port can be sealed, thereby completely sealing the body. The completely sealed body can maintain a predetermined absolute or differential pressure within the internal environment.

In accordance with embodiments of the present invention, a sufficient time for a vapor to form within the internal environment of the completely sealed body can be provided. The vacuum port can be opened and the vacuum source can be applied at the vacuum port, thereby causing a fluid including at least a portion of the vapor to exit from the internal environment. One or more substance detectors, one or more substance collectors, or both, can be used, to detect the presence of the substance within the vapor, One or more pressure sensors for detecting at least a predetermined minimum amount or rate of pressure change in the pressure of the internal environment can be provided. At least the predetermined minimum amount or rate of pressure change in the pressure of the internal environment can be detected. The detection of at least the predetermined minimum amount or rate of change in the pressure of the internal environment can be transmitted to a position outside of the internal environment. One or more trace detection tests for a substance can be performed subsequent to sealing the one or more sealable ports.

In accordance with embodiments of the present invention, a cargo shipment security kit can include an apparatus, which can include a flexible body configured to completely enclose and contain cargo within an internal environment and maintain a predetermined pressure within the internal environment. The apparatus can include a sealable vacuum port disposed on and through the body and configured to couple with a vacuum source for creating a vacuum within the internal environment. The apparatus can include one or more sealable ports disposed on and through the body, positioned to cause a turbulent flow through a predetermined volume of the internal environment of the body when the vacuum source is applied at the vacuum port and fluid is caused to enter the internal environment through the one or more sealable ports. The turbulent flow can be sufficient to dislodge at least a trace amount of a substance. The kit can include one or more substance detectors, one or more substance collectors, or both, configured to be positioned in such a way as to intercept fluid flowing from the internal environment to an external environment outside the body enable detection of the presence of the substance exiting from the internal environment.

In accordance with embodiments of the present invention, the kit can include a vacuum source. The kit can include an ion mobility spectrometer device.

BRIEF DESCRIPTION OF THE FIGURES

These and other characteristics of the present invention will be more fully understood by reference to the following detailed description in conjunction with the attached drawings, in which.

DETAILED DESCRIPTION

Figure 1A:
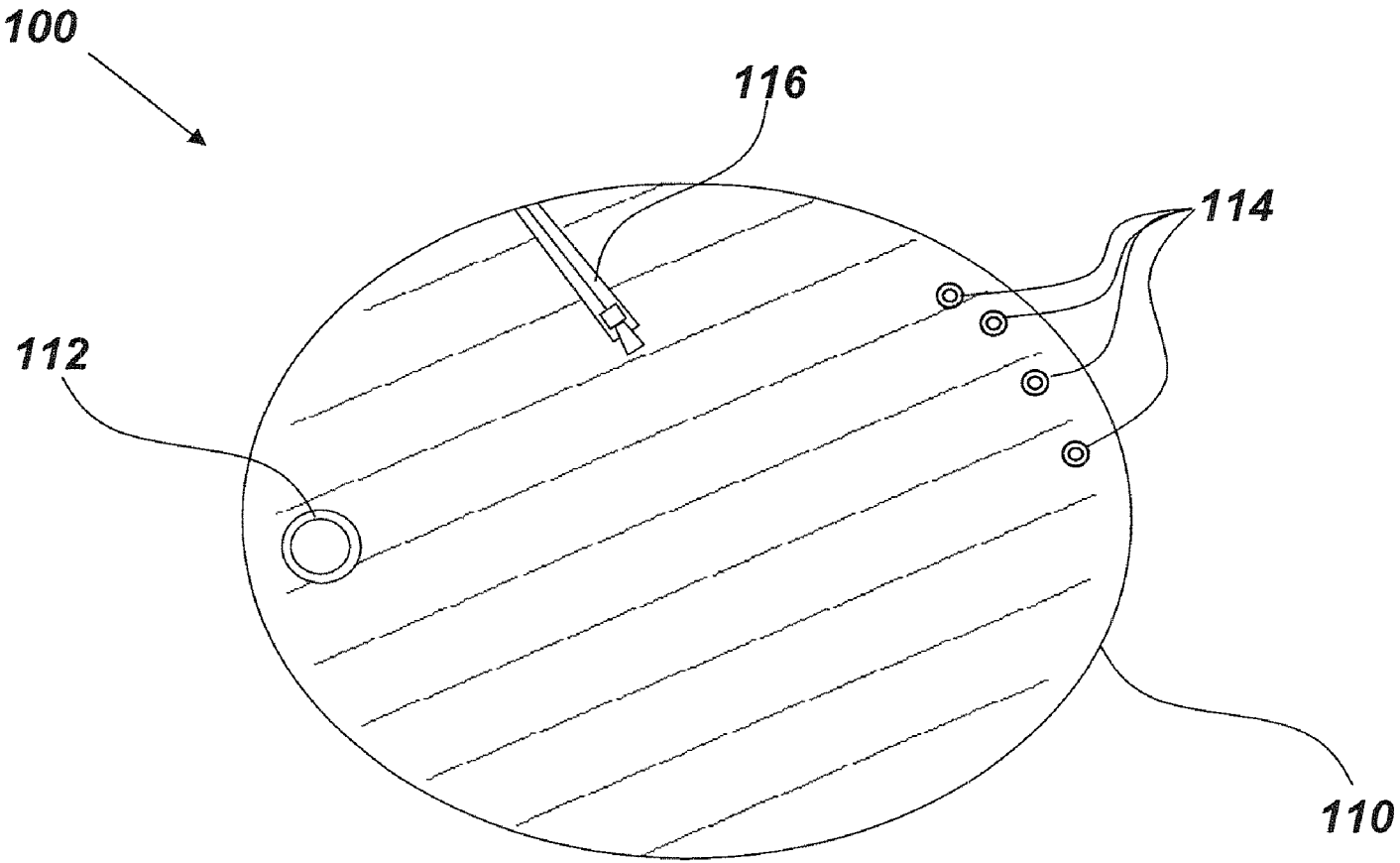
FIG. 1 is an illustrative diagram of a security enclosure in a closed configuration, according to aspects of the present invention.
FIG. 1B is an illustrative diagram of the security enclosure of FIG. 1A in a closed configuration, according to aspects of the present invention.
FIG. 1C is an illustrative diagram of a one-piece security enclosure in an open configuration, according to embodiments of the present invention.
FIG. 1D is an illustrative diagram of a two-piece security enclosure in an open configuration, according to embodiments of the present invention.

An illustrative embodiment of the present invention relates to security shipment systems and methods capable of detecting one or more substances. In an illustrative embodiment, a security enclosure can be configured to entirely enclose and contain contents such as cargo within an internal environment. The security enclosure can include a body having a vacuum port that can be sealed, as well as one or more additional sealable ports. When a vacuum is applied at the vacuum port and the one or more additional sealable ports are open, a turbulent flow such as an air flow can be caused to pass through a volume of the internal environment. The turbulent flow can collide with a substance that is to be detected, thereby dislodging at least a trace amount of the substance (e.g., nanoparticulates or other sized particulates of the substance). The dislodged substance then can be detected by one or more detectors positioned to intercept fluid flowing out of the internal environment. The one or more additional sealable ports can be positioned in such a way as to cause the turbulent flow to pass through a predetermined volume of the internal environment. The predetermined volume may be a maximized portion of the internal environment, which can provide the benefit of maximizing the likelihood of detecting a substance's presence within the internal environment. The security enclosure also can be flexible, evacuable, and/or sealable, so as to enable the internal environment to be evacuated and sealed from fluids or vapors. One or more additional sensors can enable detection of a pressure change, such as a change in the absolute pressure of the internal environment or a change in the differential pressure across the body of the apparatus. The apparatus can be opened, reopened, sealed, and resealed, so as to enable multiple iterations of detection tests.

Embodiments of the present invention provide apparatuses, systems, and associated methods for the trace detection of explosives, narcotics, and other illicit or hazardous materials within a security enclosure, as well as for the detection of access, intrusion, or penetration into a security enclosure, thereby enhancing protection of the enclosed contents from tampering, introduction of foreign objects and materials, theft, changes to the internal environmental conditions, and accidental damage. The present invention is not limited by particular types of enclosed contents or by particular security/cargo applications. As non limiting examples, applicable enclosed contents can include food products, pharmaceutical products, merchandise, storage rooms, vaults, any package or container thereof, and any other package or container that is large or small, rigid or non-rigid, opaque or transparent, and/or movable or stationary.

In accordance with some embodiments of the present invention, the contents to be enclosed (such as a cargo shipment) first can be deemed safe (e.g., by screening) prior or subsequent to loading/unloading. Detection tests can be performed for the presence of substance(s), such as threatening or illicit materials. In accordance with some embodiments the contents to be enclosed include cargo containers and air cargo unit load devices (ULDs). In the case of cargo and freight, possible screening may include such government-regulated techniques such as a physical search and manifest verification, X-ray systems, explosive detection systems, explosive trace detection, explosives detection canine teams, radiation detection equipment, and non-intrusive imaging (NII) with gamma or neutron irradiation.

In accordance with some embodiments of the present invention, contents can be enclosed in a sealable container that is attached to a pump or compressor via an external, sealable flange that interfaces with the interior of the security enclosure. The pump or compressor can be used to apply a vacuum or other negative pressure or a positive pressure to the interior of the security enclosure. The positive or negative differential pressure between the interior of the security enclosure and the surroundings can be relatively small, for example on the order of about 5-500 mm Hg. Alternatively, the positive or negative differential pressure can be relatively large, such as on the order of greater than about 500 mm Hg. In an illustrative embodiment of the present invention, the applied pressure is at least about 5 mm Hg and no greater than about 500 mm Hg. For example, this pressure can be achieved for an enclosure with an internal volume up to about 1275 $ft^3$, for example with dimensions of about 96"×238"×96", by applying a low cost vacuum source with a flow rate of about 350 cfm for a period of about 2-120 seconds. More powerful vacuum sources can be used to reduce this pump down time. It should be understood that any range described herein includes any value contained within that range, as well as sub ranges contained within that range. For example, about 2-120 seconds includes, as examples, all of the following: about 5 seconds, about 60 seconds, about 5-80 seconds, and about 1 minute.

Many applied pressures may be suitable with embodiments of the present invention. These pressures can change depending on various selections of materials, enclosed contents, and other related factors, as would be appreciated by one skilled in the art. For example, the applied pressure must be within the tolerance (designed or otherwise) of the security enclosure, as would be appreciated by one skilled in the art. In some embodiments where the security enclosure is constructed from a fabric having seams, the applied pressure cannot be so strong as to cause the seams to burst.

In addition to the apparatus material tolerances, the applied pressure may be constrained in special circumstances to prevent causing damage to the enclosed contents. For example, the presence of exposed volatile material may limit the extent of an applied vacuum. Additionally, the compressibility of the enclosed contents may limit the extent of applied positive or negative pressure. The presence of internal voids or enclosed pockets in the contents may limit the extent of applied positive or negative pressure. The strength of packaging and sealing materials used on the contents may limit the extent of applied positive or negative pressure.

Safety concerns may also impose constraints upon the magnitude and sign of an applied pressure to an internal environment of security enclosure according to embodiments of the present invention. Application of a positive pressure may provide poorer stability to an internal environment enclosed by the security enclosure that a positive pressure since inadvertent bumps capable of compressing the volume of a non rigid enclosure can create spikes in internal conditions such as pressure. Furthermore, if too great of a positive pressure is used, an inadvertent or intentional release of the positive pressure may occur during normal handling of the security enclosure (e.g., when opening). This could present a potentially harmful situation for workers and objects in the vicinity. Another safety consideration that may limit the magnitude and sign of the pressure applied to the security enclosure is in whether living creatures are contained therein or are suspected to be contained therein. For example, if the presence of stowaways within the contents to be enclosed is suspected, or if the contents to be enclosed contain living creatures or animals, then it may be desirable for the applied pressure to remain within the limits of corresponding livable conditions.

In accordance with some embodiments of the present invention, the security enclosure can include a flange and pumping port disposed on a body of the security enclosure. The flange can be sealed once the desired applied pressure inside the security enclosure is achieved. A pump or compressor can be used to apply a vacuum pressure or other internal pressure to interior environment. The pump or compressor can be inserted at a vacuum port or other type of pumping port, in order to establish an internal pressure. In some embodiments the internal pressure is different from the external pressure (i.e., there is a nonzero differential pressure acting on the security enclosure). The pump or compressor can be removable without compromising the applied pressure prior or subsequent to sealing the flange.

In accordance with some embodiments of the present invention, intrusion or damage to the security enclosure is detected by one or more pressure sensors when the pressure of the internal environment goes above or below a predetermined pressure. Various types of predetermined pressures will be appreciated by one skilled in the art upon reading the present specification. For example, the predetermined pressure can be an absolute pressure value within an internal environment that is enclosed by the security device. The predetermined absolute pressure value can be equal to the applied pressure, or it can be a different pressure value from the applied pressure, such as a value that accounts for expected or routine pressure changes that may naturally occur during transport. As a second example, the predetermined pressure can be a predetermined differential pressure between the interior of the security enclosure and the exterior of the security enclosure.

In accordance with some embodiments of the present invention, intrusion or damage to the security enclosure is detected by one or more pressure sensors if at least a predetermined minimum amount of pressure change or rate of pressure change in the pressure of the internal environment. The predetermined minimum amount of pressure change or rate of pressure change can account for gradual changes in the differential pressure due to entrapped volumes that gradually equilibrate with the applied pressure. For example, if the security enclosure encloses an imperfectly sealed box having higher internal pressure than the net pressure of the internal environment, then leakage will occur in the box until the two pressures equilibrate. In some embodiments, such gradual changes can be accounted for by estimating or measuring the percentage of the internal volume occupied with potentially or known slow-leaking entrapped volumes, and further by estimating or measuring the initial pressure inside such slow-leaking entrapped volumes.

Additional fluctuations in the internal pressure may occur subsequent to sealing the apparatus. For example, if the internal temperature of the security enclosure changes, then the pressure will correspondingly change. Pressure fluctuations due to temperature variation are directly proportional to the value of change in temperature and can be predicted using the Ideal Gas Law. An additional potential source of internal pressure fluctuations is the generation and release of vapors within the security enclosure, which may occur as a result of chemical reactions, chemical degradation, combustion, or explosion. One skilled in the art will appreciate that if a sufficient pressure or pressure gradient has been applied, then the pressure of the internal environment will only become equal to the pressure of the surroundings if the security enclosure has been opened or penetrated, for example as a result of access, intrusion or damage, excepting the generation of extreme volumes of vapor inside the enclosure.

Detection of intrusion or damage to the security enclosure that is evidenced by equilibration of the internal environment with the external environment can be achieved in many ways. For example, such detection can be achieved using visual inspection of the shape of the security enclosure. Other visual inspection techniques are systems involving color changing patches and the like are well known in the art. Detection of pressure equilibration can also be achieved by physically probing the security enclosure to determine if tension in the security enclosure has occurred. For example, enclosing objects/contents such as pallets in a flexible security enclosure according to embodiments of the present invention, and then providing a negative pressure (such as a vacuum) to the internal environment of the security enclosure, will result in the security enclosure generally conforming to the shape of the enclosure contents. For example, the flexible security enclosure will bend inward to conform to the protrusions of the enclosed contents. Tension on the body of the security enclosure due to the differential pressure on the body maintains the body's conformant shape. If the sealed barrier provided by the security enclosure is breached subsequent to the application of the negative internal pressure, then the differential pressure will dissipate, thus causing relaxation of the body and elimination of the tension.

Intrusion into or damage to the security enclosure, as evidenced by equilibration of the internal environment of the security enclosure with the external environment of its surroundings also can be detected using any pressure-monitoring technique. For example, a pressure gauge or pressure sensor equipped with a readout can be either wholly contained within the security enclosure or integrated in the surface of the security enclosure so as to probe the absolute or gauge pressure inside the security enclosure. Any suitable pressure sensor can be used, as would be appreciated by one skilled in the art. For a pressure gauge, pressure sensor, or other pressure monitoring device placed within the security enclosure, the security enclosure can be transparent or can have a transparent portion, such as a window, which provides a line of sight that enables a user to view the pressure reading. In such embodiments, an internal pressure reading that is equal to the surrounding pressure, or sufficiently different from the pressure originally applied to the internal environment, can provide an indication that the security enclosure had been opened or penetrated as a result of access, intrusion or damage.

Intrusion or damage as evidenced by equilibration of the internal environment with the external environment of the surroundings also can be detected for a rigid or non-rigid security enclosure by including a handheld reader that communicates wirelessly with a pressure-monitoring device. For example, a pressure sensor can be wholly contained within the security enclosure or integrated into the surface of the security enclosure, so as to enable probing the absolute or gauge pressure inside the security enclosure. Similarly, a signal from the pressure-monitoring device or pressure sensor can be relayed via a wireless network, cellular communications network, or satellite communications network to a remote terminal. An internal pressure reading equal to the pressure of the external environment, or sufficiently different from the pressure originally applied to the interior, can provide indication that the security enclosure had been opened or penetrated as a result of access, intrusion or damage.

To avoid security defeat in the form of breaching, tampering, reapplying correct internal pressure, and resealing the security enclosure, a pressure-monitoring device, such as a pressure sensor that is either wholly contained within the security enclosure or integrated in the surface of the security enclosure such that it is able to probe the absolute or gauge pressure inside the enclosure can be equipped with memory. The monitoring device can be configured to automatically and continuously or periodically measure the pressure of the internal environment. The monitoring device additionally can be configured to perform any of the following functions: log the pressure reading, log a time stamp, log additional readings such as temperature value, and log additional data types corresponding with each pressure reading. The log can be accessible as a readout of the pressure-monitoring device, can be downloaded to a reader, or relayed via a wireless network, cellular communications network, satellite communications network, or other wireless communications network to a position that is outside of the internal environment, such as a remote terminal. Signal relay and transmission can occur in real-time and/or can occur when queried or remotely commanded. Such readings and cached data can provide information on when the enclosure had been opened or penetrated as a result of access, intrusion or damage.

Some alternative embodiments of the present invention implement an unsealed security enclosure. For example, one such embodiment of a security enclosure has a body that is permeable or only partly impermeable to one or more gases, liquids, or both (e.g. one or more fluids) and thus allows known amount(s) and/or rate(s) of leakage. In such embodiments, application of a differential pressure to the internal environment of the security enclosure relative to the external environment would result in a flow of a fluid (e.g., air) between the internal and external environments that is proportional to the applied differential pressure. The pump or compressor can remain attached and can continue to supply or remove air or other fluid in order to maintain a predetermined pressure within the internal environment. The air flux through the pump or compressor needed to maintain the desired internal pressure would be constant assuming the pressure of the surroundings does not change and no source of pressure-generating vapor emission is among the enclosure contents. If the pressure of the external environment is dynamic (e.g., a non pressurized or partly pressurized cabin in an airplane), the system can be configured and controlled to maintain either a constant internal pressure or a desired differential pressure, whether constant or changing. Intrusion or damage to the security enclosure would be indicated by an increase in the flux of air normally required to maintain the desired differential pressure between the internal and external environments.

As described in detail herein, additional detection of explosives, narcotics, or hazardous chemicals can be performed in conjunction with the described embodiments of the present invention, for detecting intrusion or damage to an enclosure. Specifically, air, atmosphere, or other fluid can be pulled from the security enclosure with a pumping source (such as a vacuum pump) and can be directed to a detector or to a swab or similar sampling system for subsequent inspection with a detector. For example, dislodged substance within the enclosure can be captured and/or accumulated/concentrated via the flowing fluid onto a sampling surface or in a sampling medium for analysis on a stand-alone trace detector. Analysis of the sampling medium can occur immediately after collection or it can be stored and analyzed thereafter.

Additional detection of explosive devices can be performed in conjunction with the described systems and methods for detecting intrusion or damage to a security enclosure. Specifically, if the pressure applied to the rigid or non-rigid enclosure is a negative pressure, or a vacuum, of sufficient magnitude, then devices hidden within the contents rigged to detonate or activate at a particular altitude based on a decreased pressure can be detonated or activated in a controlled environment.

FIGS. 1A through 9, wherein like parts are designated by like reference numerals throughout, illustrate example embodiments of a security enclosure according to the present invention. Although the present invention will be further described with reference to the example embodiments illustrated in the figures, it should be understood that many alternative forms can embody the present invention. One skilled in the art will additionally appreciate different ways to alter the parameters of the embodiments disclosed, such as the size, shape, or type of elements or materials, in a manner still in keeping with the spirit and scope of the present invention.

For example, the dislodged substance alternatively can be captured and/or accumulated/concentrated on a sampling surface or in a sampling medium for analysis on a stand-alone trace detector. Analysis of the sampling medium can occur immediately after collection or it can be stored and analyzed thereafter. FIG. 1A depicts a security enclosure 100 according to an example embodiment of the present invention. The security enclosure 100 can be a sealable flexible enclosure having a shape and size that is suitable for the contents intended to be enclosed and contained. Accordingly, in an example embodiment depicted in FIG. 1C and implemented for ULDs/pallets, the security enclosure 100 has a body 144 with a generally rectangular shape and which includes a flap 146 that can be fastened and/or sealed. The body 144 and flap 146 can be constructed from a single piece of material that is sealed according to any suitable fastening technique as described herein, including fastening mechanisms on the body 144 and/or flap 146. In an alternative example embodiment implemented for ULDs/pallets and depicted in FIG. 1D, the security enclosure 100 is constructed from two separate pieces of material, which can seal/fasten together with any suitable fastening technique, including fastening mechanisms on the security enclosure 100. One skilled in the art will appreciate that the present invention is not limited to any of these specific selections in shape or number of pieces of material of the security enclosure 100.

The security enclosure 100 includes a body 110 and a sealable pumping port 112 disposed on and through the body 110. For example, the sealable pumping port 112 can be a sealable vacuum port that includes a rubber flange, a hinge, and a hatch having a handle configured to rotatably open and close a fluid tight seal. The sealable pumping port 112 can be configured to receive and couple with a pumping source (such as a vacuum source), which can be used to create a turbulent flow within the security enclosure 100 or can be used to apply a positive or negative pressure to the interior of the security enclosure 100, e.g., by pumping air or other fluid into or out of the interior of the security enclosure 100. Coupling a pumping source with the pumping port 112 and applying the pumping source can result in a fluid tight seal (e.g., a fluid tight pressure seal) that prevents fluid, such as air, from escaping through the connection site of the pumping source to the pumping port 112.

The body 110 can include one or more additional sealable ports 114 disposed on and through the body 110. The size and shape of the ports 114 can be selected depending on the particular size of the body 110, the contents to be enclosed by the body 110, and other related factors discussed in greater detail herein. The ports 114 can be sealed by one or more sealing elements. For example, the sealing elements may include hatches, electronically controllable sliding doors, plugs coupled to or dissociated from the body 110 and configured to provide a seal tight fit when disposed within the ports 114, additional material that overlays the ports 114 and is fixated to the exterior or interior of the body 110 through one or more adhesives, any other sealing element, or any combination thereof.

The body 110 can be constructed from a single, continuous, monolithic piece of material, or it can be constructed from multiple pieces of material. The body 110 can be made of any suitable material. In an illustrative embodiment, the body 110 is constructed from any plastic sheet with sufficient thickness and durability to withstand the expected transportation environment and conditions. The material can be transparent, translucent, opaque, or reflective, depending on the particular commercial, etc. application and the types of sensors being included in the apparatus (e.g., light sensors). The material can be impermeable or partly impermeable to one or more desired fluids, including gases and liquids. In an illustrative embodiment, the material is substantially impermeable at least to air and other atmospheric gases.

The body 110 can include one or more fluid tight fastening members such as fastening member 116 for fastening two edges of the body 110 together. For example, the fastening members can include fluid tight seam(s), fluid tight zipper(s), fluid tight zip lock member(s), any other type of fastening members, or any combination thereof. As depicted in FIG. 1A, the body 110 of the illustrative embodiment includes a fastening member 116, which comprises a fluid tight zipper. For example, the air tight zipper sold under the name MaxiGrip by ITW MaxiGrip of Somerset, N.J., may be used.

When the fastening member is fastened (e.g., unzipped), the security enclosure 100 completely encloses any contents contained therein. As used herein, the term "enclose," "enclosure," and any derivation thereof, does not include a requirement that the enclosure (e.g., security enclosure) be sealed, such as with a fluid tight seal. Rather, it should be understood that the security enclosure 100 may enclose any contents contained therein while simultaneously remaining unsealed and/or while simultaneously having an open vacuum port, one or more open additional port(s), or both. When unzipped, the body 110 of FIG. 1A can provide a space that is sufficiently large to enable contents to be situated within the body 110.

Figure 1B:
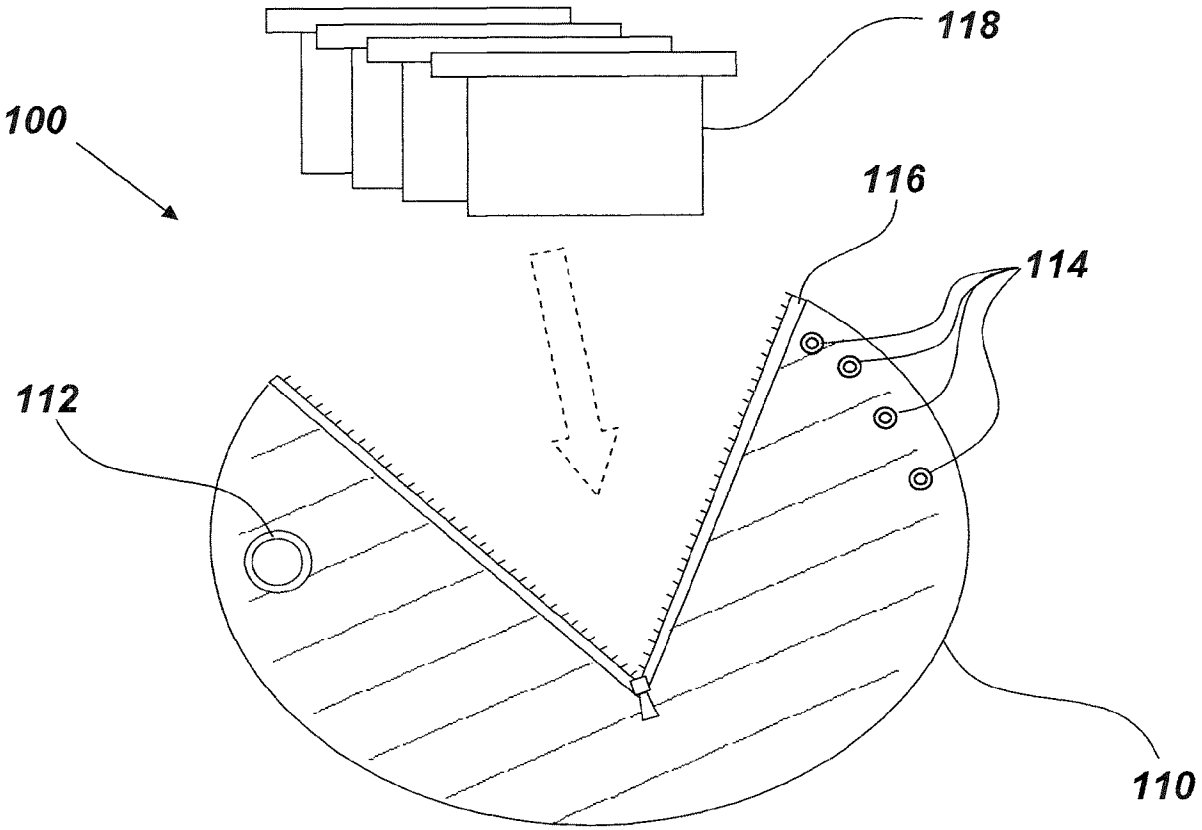
Figure 1C:
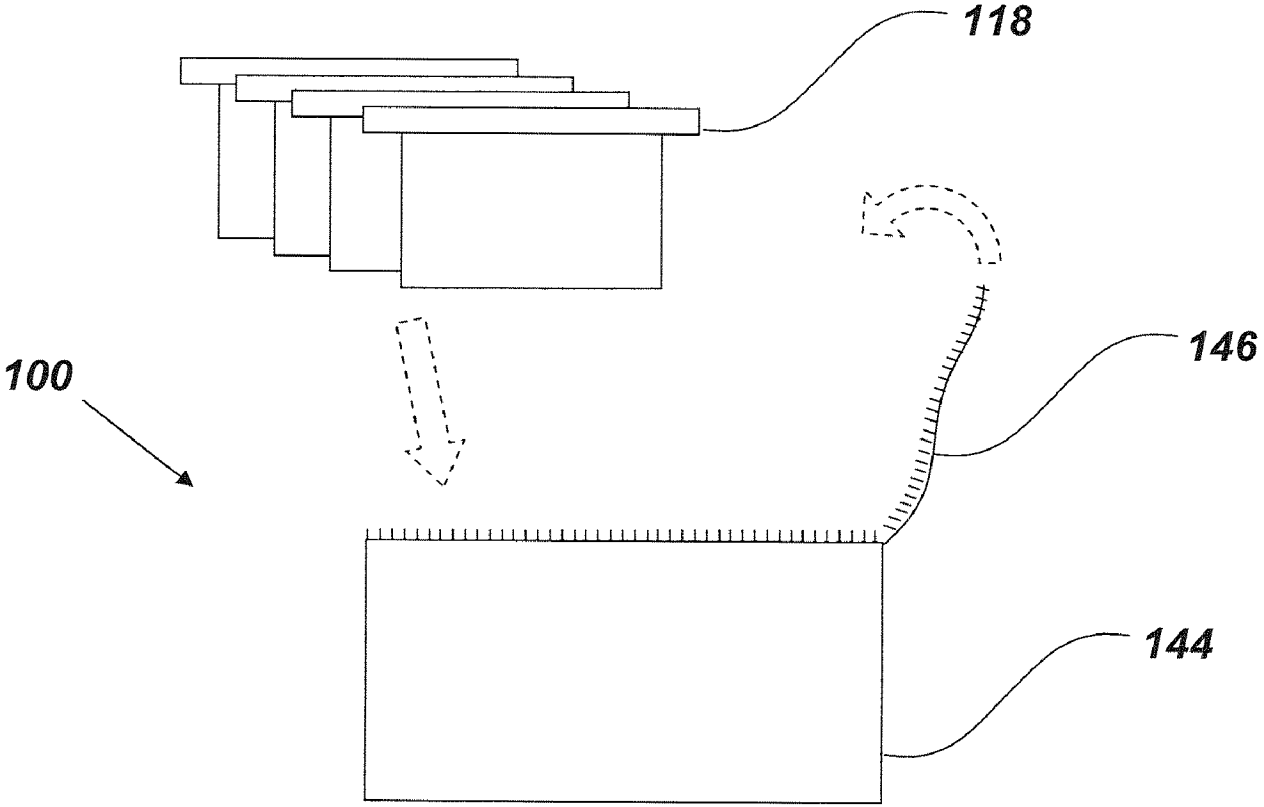

Accordingly, the security enclosure 100 can have an open configuration (e.g., unzipped configuration) and a closed configuration (e.g., zipped configuration). FIG. 1A depicts the security enclosure 100 in the closed configuration. FIG. 1B depicts the security enclosure 100 in the open configuration, for enabling contents 118 to be situated therein. As described herein, the security enclosure 100 can be converted to a closed configuration by fastening the fastening member 116 (e.g., zipping the fluid tight zipper). Other suitable mechanisms for converting the security enclosure 100 from an open configuration to a closed configuration include sealing a zip lock member, fastening two portions of the body 110 to form a seam (e.g., by heat treatment, sewing, etc.), adhesive flaps, and other suitable mechanisms for providing a closed configuration. The fastening members can be suitable for only a single use or can be reusable fastening mechanisms. For example, a heated seam may not be suitable for unfastening and refastening. However, a zipper suitably can be unfastened and refastened. It should be appreciated that the fastening members can be fluid tight and/or vapor tight if so desired. Accordingly, while illustrative embodiments described herein may include a sealable fastening member, embodiments of the present invention are not limited to security enclosures having a fluid tight or vapor tight seal, such as a pressure seal.

Figure 2:
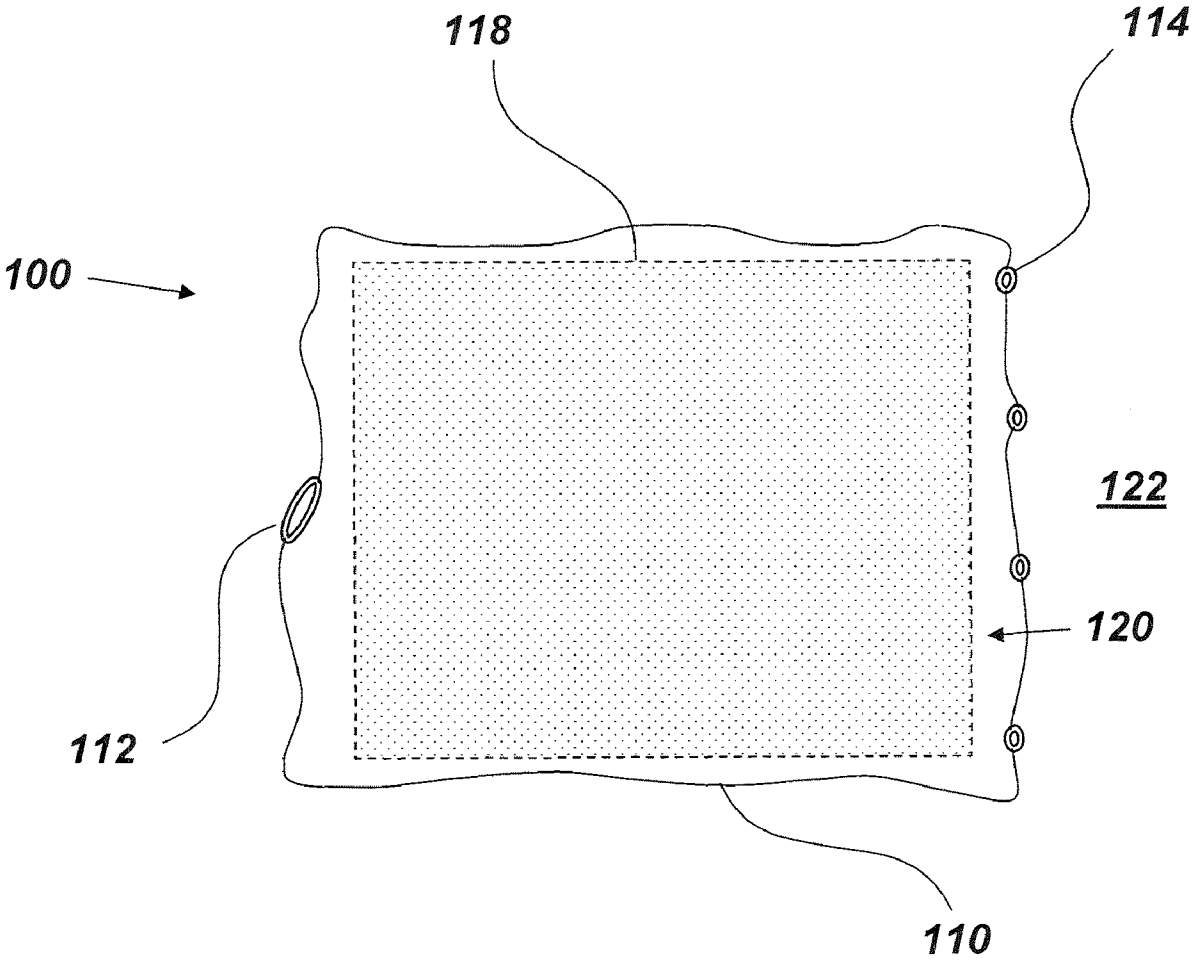
FIG. 2 is an illustrative diagram of a security enclosure completely enclosing and containing contents, according to embodiments of the present invention.

FIG. 2 depicts a security enclosure 100 in a closed configuration and completely enclosing and containing contents 118. For purposes of clarity, the contents 118 are depicted as having a rectangular like shape. However, the contents 118 can include any contents suitable for being enclosed in the manner described herein and may have any shape. As examples, the contents 118 can include pallets, ULDs, packages, containers, cargo, shipments, and any other contents 118. The security enclosure 100 encloses the contents 118 in an internal environment 120. An external environment 122 is also depicted, which includes anything not enclosed by the security enclosure 100. The internal environment 120 and the external environment 122 can have substantially identical environmental conditions (pressure, temperature, etc.) prior to the security enclosure 100 being sealed and provided with a different internal environment.

Figure 1D:
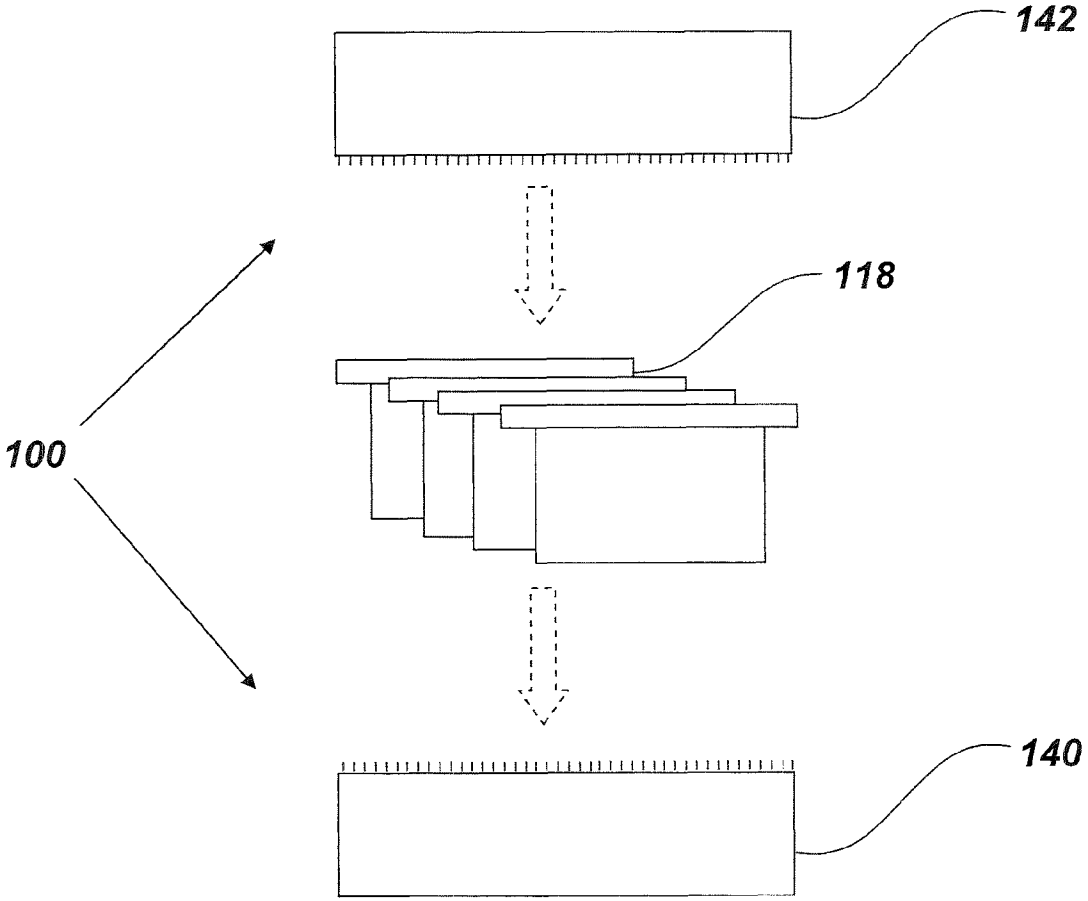

In the example embodiment of FIG. 1D of the security enclosure 100 comprising two separate pieces of material, contents 118 can be loaded into a first piece 140, e.g., from above. A second piece 142 then can be applied to the uncovered portion of the contents 118, in order to completely contain and enclose the contents 118. For embodiments involving fluid and/or vapor seals, the two separate pieces 140 and 142 can be sealed by any suitable sealing mechanism, as described herein. In other embodiments, the two pieces 140 and 142 are fastened together using any suitable fastening technique, including fastening members included in the security enclosure 100.

Figure 3:
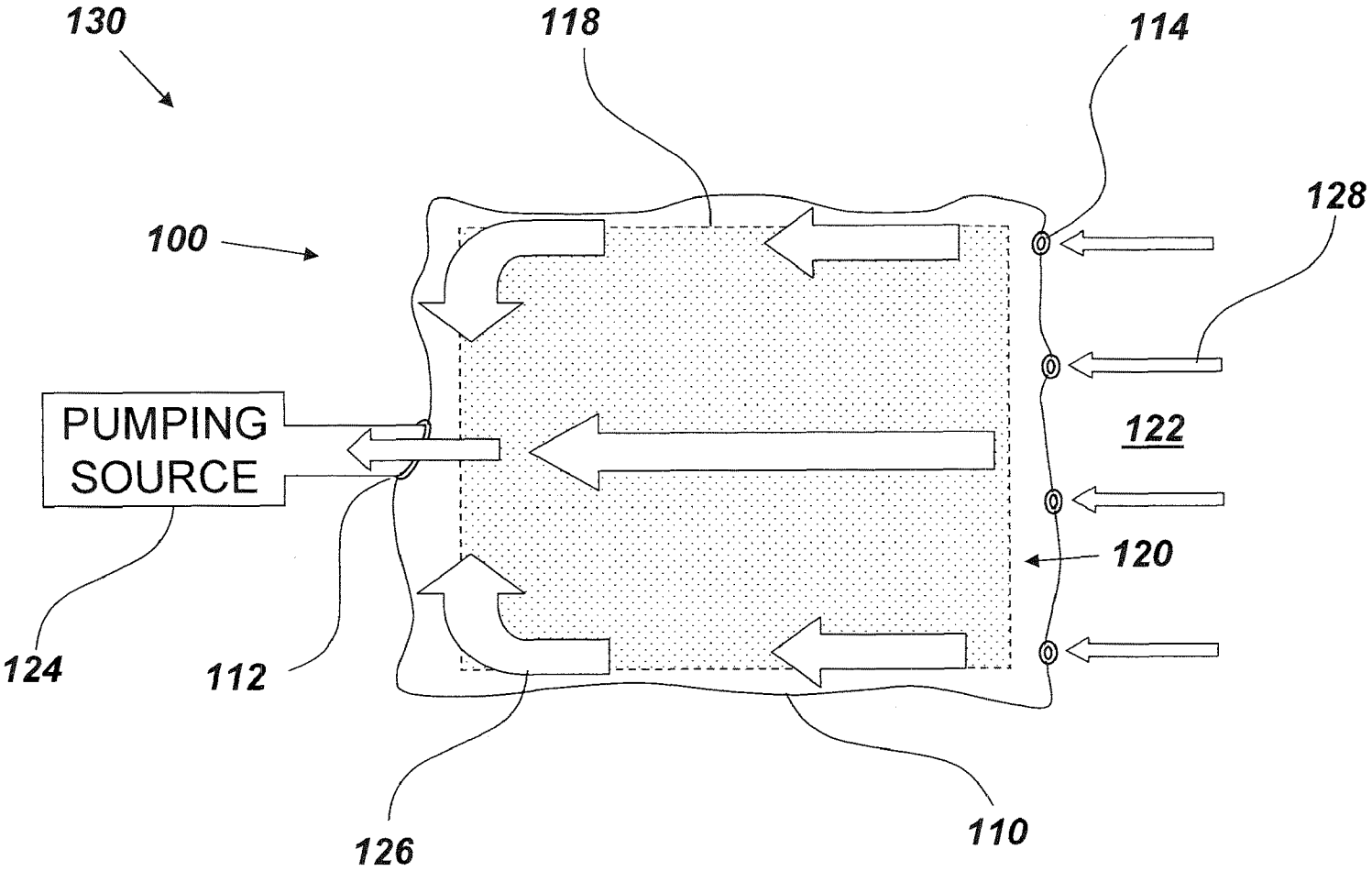
FIG. 3 is an illustrative diagram of a system including the security enclosure of FIG. 2 and having a turbulent flow caused to pass through an internal environment of the security enclosure, according to aspects of the present invention.

The pumping port 112 of the security enclosure 100 can be configured to receive and couple with a pumping source, such as a vacuum pump connected to a hose or other conduit. For example, FIG. 3 depicts a system 130 including the security enclosure 100 of FIG. 2 coupled with a pumping source 124. When the pumping source 124 is applied at the pumping port 112, a fluid 128 is caused to enter the internal environment through the one or more sealable ports 114. Said differently, the open, sealable ports 114 and the open pumping port 112 enable a turbulent flow 126 within the body 110 of the security enclosure 100 at least in response to the application of the pumping source 124 at the pumping port 112.

The one or more sealable ports 114 can be positioned in such a way as to cause the turbulent flow 126 within the body 110 to pass through at least a predetermined volume of the body 110. The ports 114 may be further positioned in such a way as to cause the turbulent flow 126 within the body 110 to pass through only a predetermined volume or sub-volume of the body 110. The particular positions of the ports 114 will vary from case to case depending on the type, dimensions, etc. of the security enclosure 100 and of the contents 118 to be enclosed. One skilled in the art can readily determine the required positions, sizes, and/or shapes necessary to enable a turbulent flow 126 entering the ports 114 to pass through a predetermined volume of the body 110 when enclosing contents 118. The ports 114 further can be positioned to maximize the volume through which the turbulent flow 126 passes. Said differently, the predetermined volume can be a substantially maximized volume. For example, the substantially maximized volume may be a majority of the volume of the body 110, substantially the entire volume of the body 110 when enclosing the contents 118 in a closed configuration, or any other maximized volume.

The sealable ports 114 and the pumping port 112 can be sealed so as to enable the internal environment 120 to be sealed from the external environment 122. Furthermore, in some embodiments the internal environment 120 is provided with one or more distinguishing environmental characteristics that are different from the external environment. For example, the internal environment may be provided with a reduced pressure, such as a vacuum. Other environmental characteristics, such as temperature, humidity, exposure to light, presence of one or more chemicals or substances, and other distinguishing environmental factors may also be provided to the internal environment 120. Detection of a breach, intrusion, tampering, and the like can be based on the detection of loss of the distinguishing characteristic, as would be appreciated by one skilled in the art.

Figure 4:
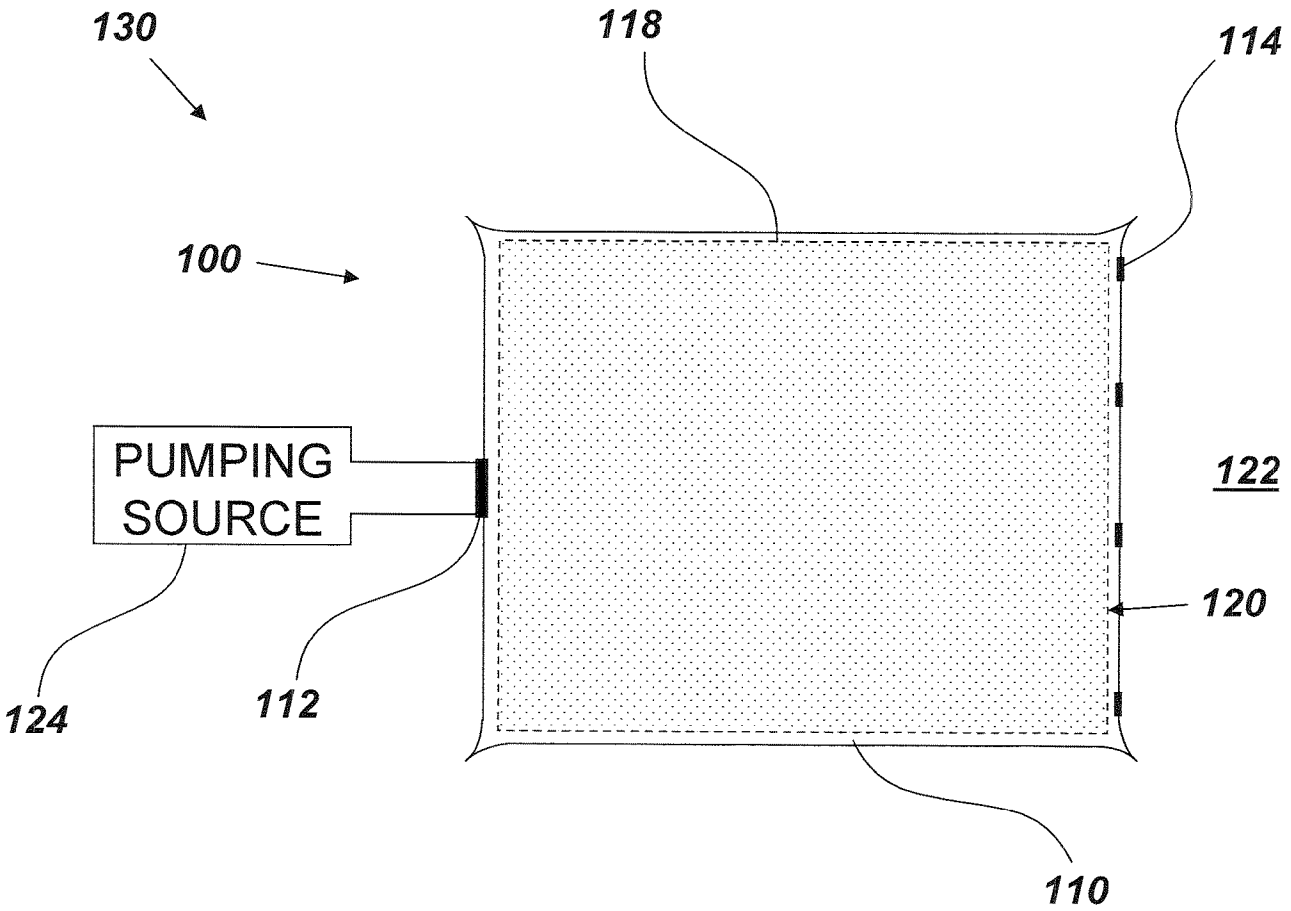
FIG. 4 is an illustrative diagram of a sealed security enclosure according to embodiments of the present invention.

FIG. 4 depicts the security enclosure 100 of FIG. 3 in a sealed configuration and completely enclosing contents 118. The sealed ports 114 prevent further fluid from passing into the body 110 of the security enclosure 100. The pumping source 124 can be coupled to the pumping port 112 when in the pumping port 112 is sealed or unsealed. The internal environment 120 of FIG. 4 possesses a vacuum pressure. Any suitable vacuum pressure may be used with embodiments of the present invention. In the illustrative embodiment, the pressure is at least about 50 mm Fig less than the lowest reasonable expected atmospheric pressure to be encountered during an instance of vulnerability to tampering, theft, or damage once prepared for conveyance or while in transit. In other embodiments the pressure is about 50 mm Fig less than the lowest reasonable expected atmospheric pressure to be encountered during an instance of vulnerability to tampering, theft, or damage once prepared for conveyance or while in transit. In an example embodiment implemented for a shipment that originates, arrives at, or passes through locations on the ground having an altitude of up to about 9,000 feet where a minimum expected pressure is about 543 mm Hg, a pressure of about 500 mm Hg or less is applied to the internal environment 120. In most cases, the cargo hold of aircraft and other vehicles are maintained at pressures no lower than the equivalence of about 10,000 ft in altitude. For purposes of clarity, there is some space depicted between the body 110 and the contents 118. However, in the illustrative embodiment, the security enclosure 100 is flexible and will substantially conform to the shape of the contents upon a vacuum pressure being provided within the internal environment 120.

One or more substance detectors, substance detector systems, or collection surfaces for collecting at least a trace amount of a substance to be detected by a detector, can be included in the system 130. All such embodiments are referred to herein as including one or more substance detector and/or collectors 518 (see FIG. 5). As an example of an embodiment including one or more substance detectors, one or more actual detectors, such as a spectrometer, may be included in the system 130. The detectors further can be included in the security enclosure 100. As an example of an embodiment having one or more substance collectors, the security enclosure 100 can include one or more collection surfaces for collecting one or more substances, e.g., substances by a turbulent flow within the internal environment 120. In such embodiments, the substance collector can capture and/or accumulate/concentrate a substance carried by the turbulent flow through the security enclosure 100. The collection surface can be analyzed by any stand-alone trace detector. The stand-alone trace detector may be included in the system 130 or may be separate from the system 130. In either case, analysis of the sampling medium can occur immediately after collection or it can occur thereafter, for example subsequent to storing the sample. For embodiments of the security enclosure 100 having a substance collector, the embodiments may additionally include a stand-alone substance detector, a substance detector coupled to the substance collector, or a combination thereof.

Any suitable apparatus or system for detecting the presence of a particular substance can be used with embodiments of the present invention, including spectrometers (e.g., mass spectrometers), chromatographers (e.g., gas chromatographers, liquid chromatographers, x-ray chromatographers), analyzers (e.g., particle, vapor), any other suitable detection apparatus, and any combination thereof. In an illustrative embodiment the substance detector is an ion mobility spectrometer device that utilizes ion mobility spectrometry. Any suitable substance collector for collecting a particular substance can be used with embodiments of the present invention, including a collection surface comprising any suitable medium into or onto which one or more substances will be absorbed and/or become entrained. Depending on the selection of a type of substance detector and/or collector, the substance detector and/or collector can be disposed in any suitable position, as would be appreciated by one skilled in the art. For example, the substance detector and/or collector can be coupled to the inside, the outside, or both of the security enclosure 100 so as to be exposed to just the internal environment 120, just the external environment 122, or both. Additionally or alternatively, the substance detector and/or collector can be coupled to the pumping source 124, for example so as to be disposed within the pumping source 124 or so as to be coupled to the pumping source via a hose or other conduit. In an illustrative embodiment the substance detector and/or collector is positioned so as to encounter all fluid being pumped through or out of the enclosure.

Figure 5A:
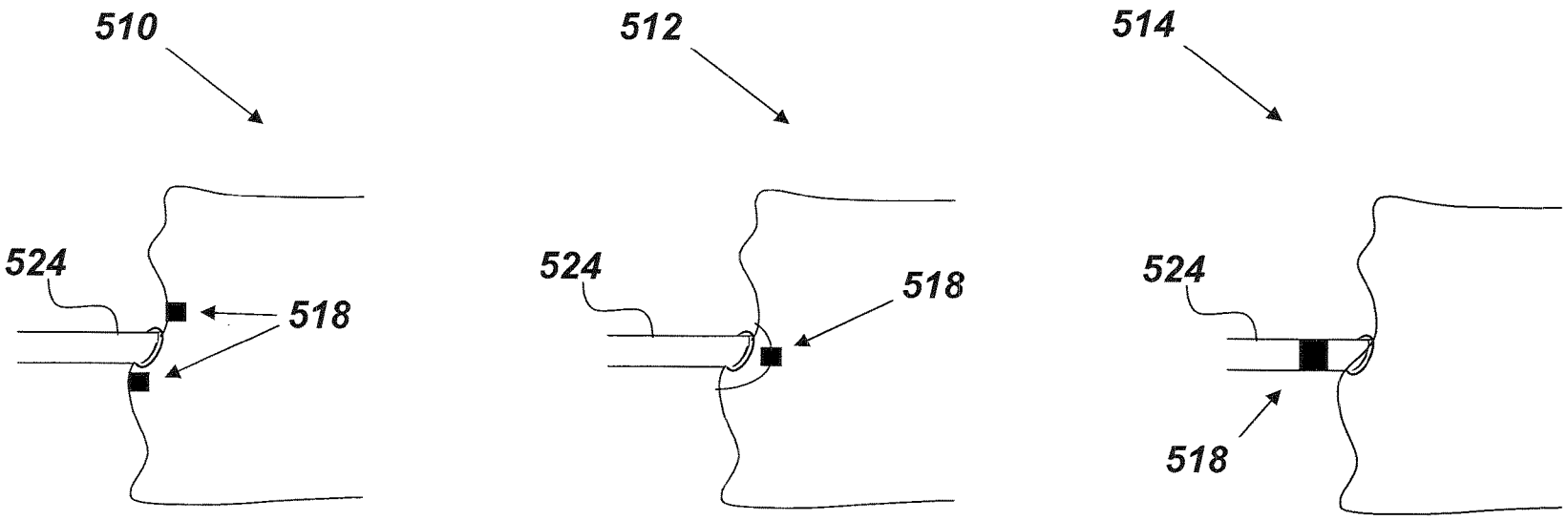
FIG. 5A depicts illustrative diagrams of variously positioned substance detectors and/or substance collectors, according to embodiments aspects of the present invention.
Figure 5B:
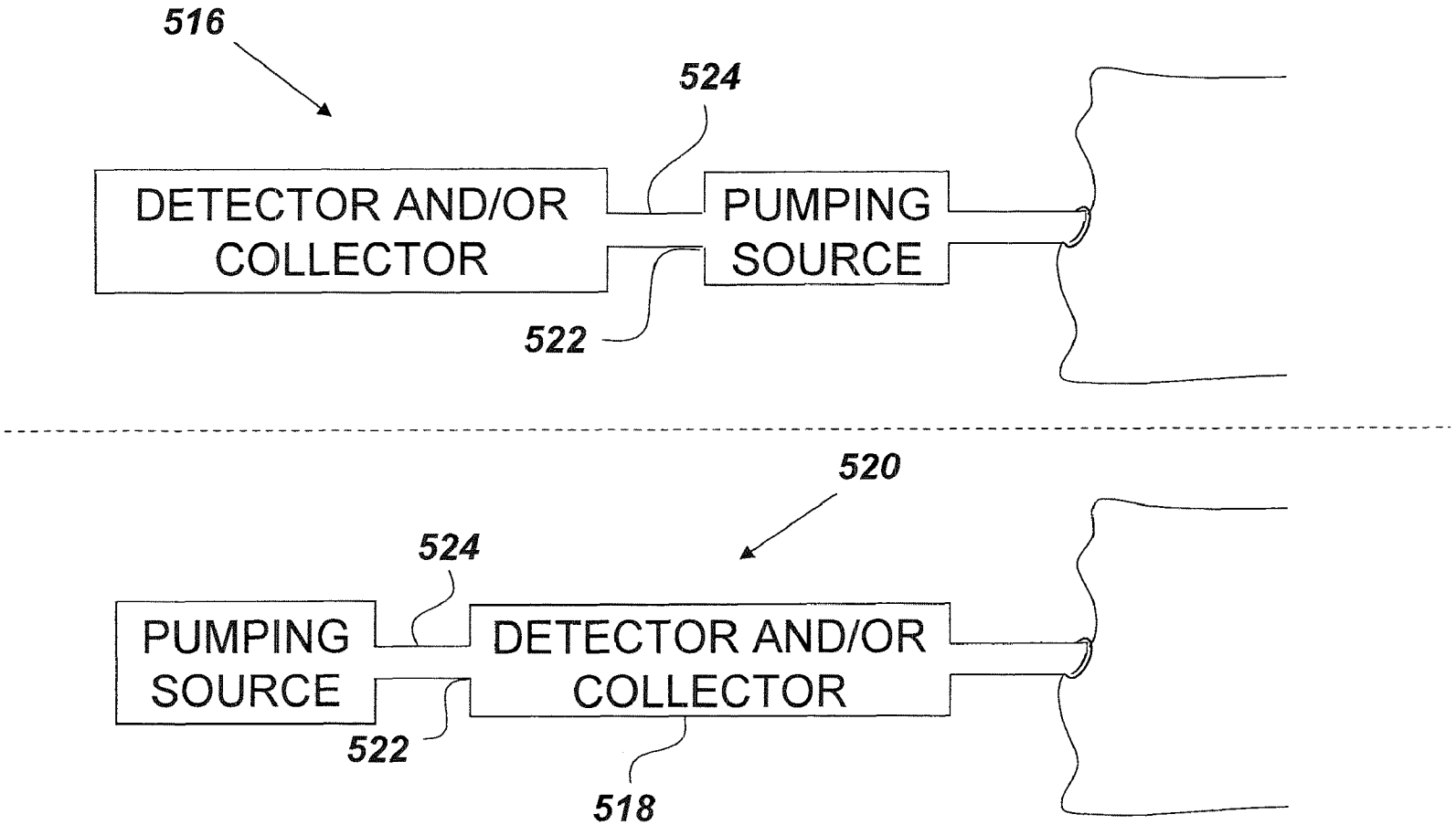
FIG. 5B is an illustrative diagram of a substance detector coupled to a pumping source, according to embodiments of the present invention.

As examples, FIGS. 5A and 5B depict four embodiments including the substance detector and/or collector 518. The detector and/or collector 518 can be coupled to the inside of the body 110 of the security enclosure 100 directly, for example as in system configuration 510, or can be coupled indirectly via a screen or other connection, for example as in system configuration 512. The detector and/or collector 518 can be coupled to a hose 524 connecting the security enclosure 100 to the pumping source, for example as in system configuration 514. The hose 524 or other conduit can be included in the pumping source or in the security enclosure 100. The substance detector 518 and/or collector alternatively or additionally can be disposed within the pumping source (embodiment not shown), and/or can be connected coupled to the pumping source at its output 522, for example as in system configuration 516. In such system configurations as 516, the substance detector and/or collector 518 can be coupled for example via the hose 524 or other conduit. In another system configuration 520, the detector and/or collector 518 can be positioned to intercept exiting fluid prior to the fluid passing through the pumping source, as depicted in the figure.

Figure 6:
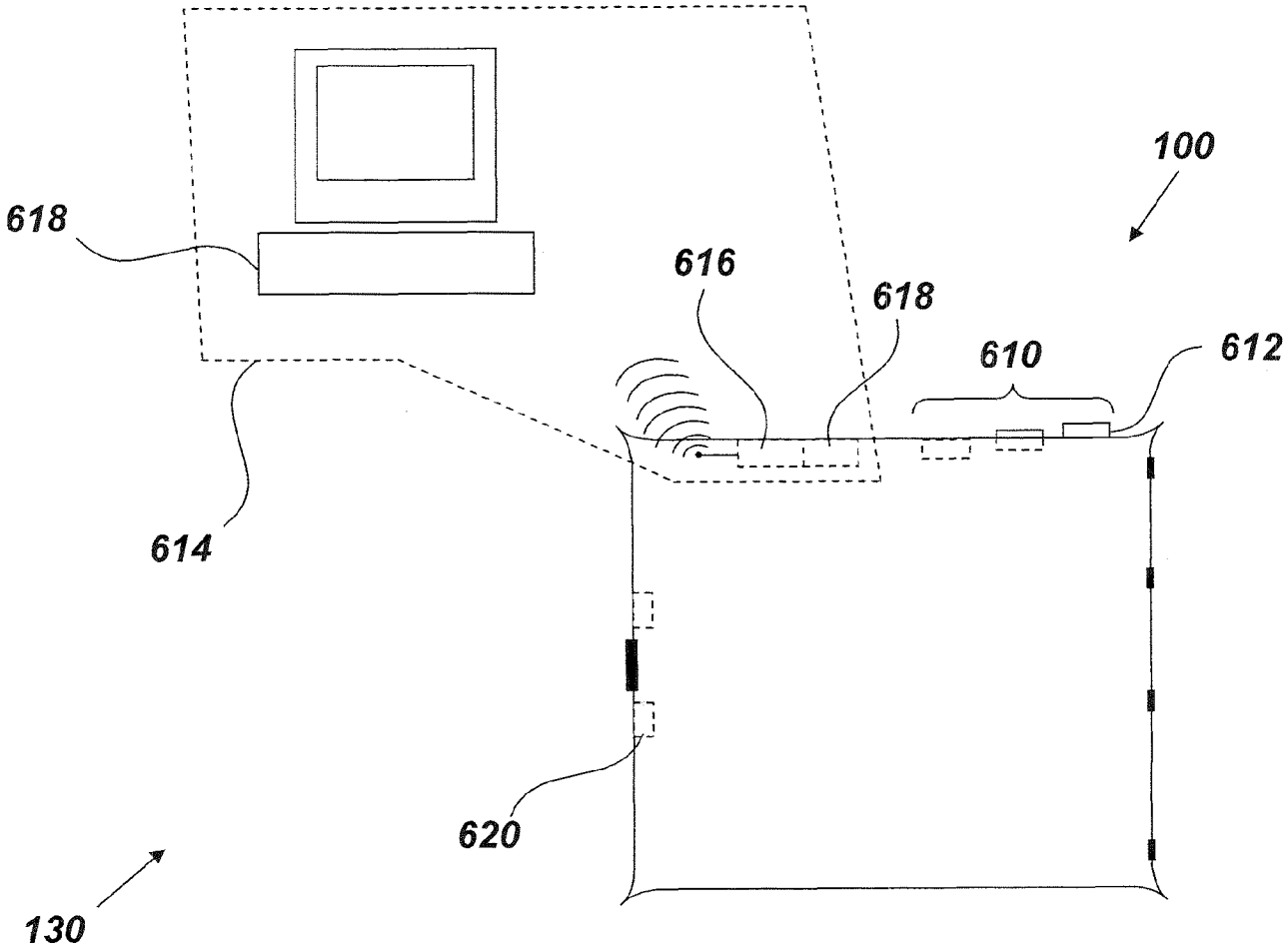
FIG. 6 is an illustrative diagram of additional optional features for inclusion in a cargo shipment security system, according to further embodiments of the present invention.

FIG. 6 depicts one or more additional features that can be included in accordance with embodiments of the present invention. The security enclosure 100 can include one or more environmental sensors such as a pressure sensor 612. The environmental sensors can be disposed within, through, and/or on the body 110 of the security enclosure 100 and can be exposed to just the internal environment 120, just the external environment 122, or both, as depicted in FIG. 6. The sensors can be included as a system 610 of sensors, or can be included as a single sensor. In addition to pressure sensors such as pressure sensor 612, other environmental sensors such as humidity sensors, temperature sensors, electrical sensors (e.g., resistance sensors, voltage sensors, capacitance sensors, conductance sensors, electricity sensors, and other electrical sensors), light sensors, other sensor, or any combination thereof, can be included.

Additionally or alternatively, the system 130 can include one or more communications systems 614. The communications systems 130 can include one or more communications devices 616, which can be disposed within, through, and/or on the security enclosure 100, for example within, through, and/or on the body 110 of the security enclosure 100. The communications device 616 can include one or more wireless transmitters, transceivers, receivers, and other wireless communications devices. The communications device 616 can be in communication with any sensor that is provided in the system 130, including any environmental sensor such as 612 and/or any substance detector and/or collector such as 620. The communications system may additionally include a receiving component 618, which can be any suitable receiver, transceiver, computer workstation, other computing system, and any other wireless or other communications device or communications network suitable for receiving a signal transmitted from the communications device 616.

One or more additional hardware components 618 may be included in the communications system 614. The hardware components 618 may be in communication with the communications device 616 to enable further desired functionality. By way of example, a processor and memory can be included for storing/buffering data in response to a sensor reading, including readings from a pressure sensor, readings from another environmental sensor, and/or readings from a substance detector and/or collector. The hardware components 618 may be disposed within, through, and/or on the security enclosure 100, for example within, through, and/or on the body 110.

Figure 7:
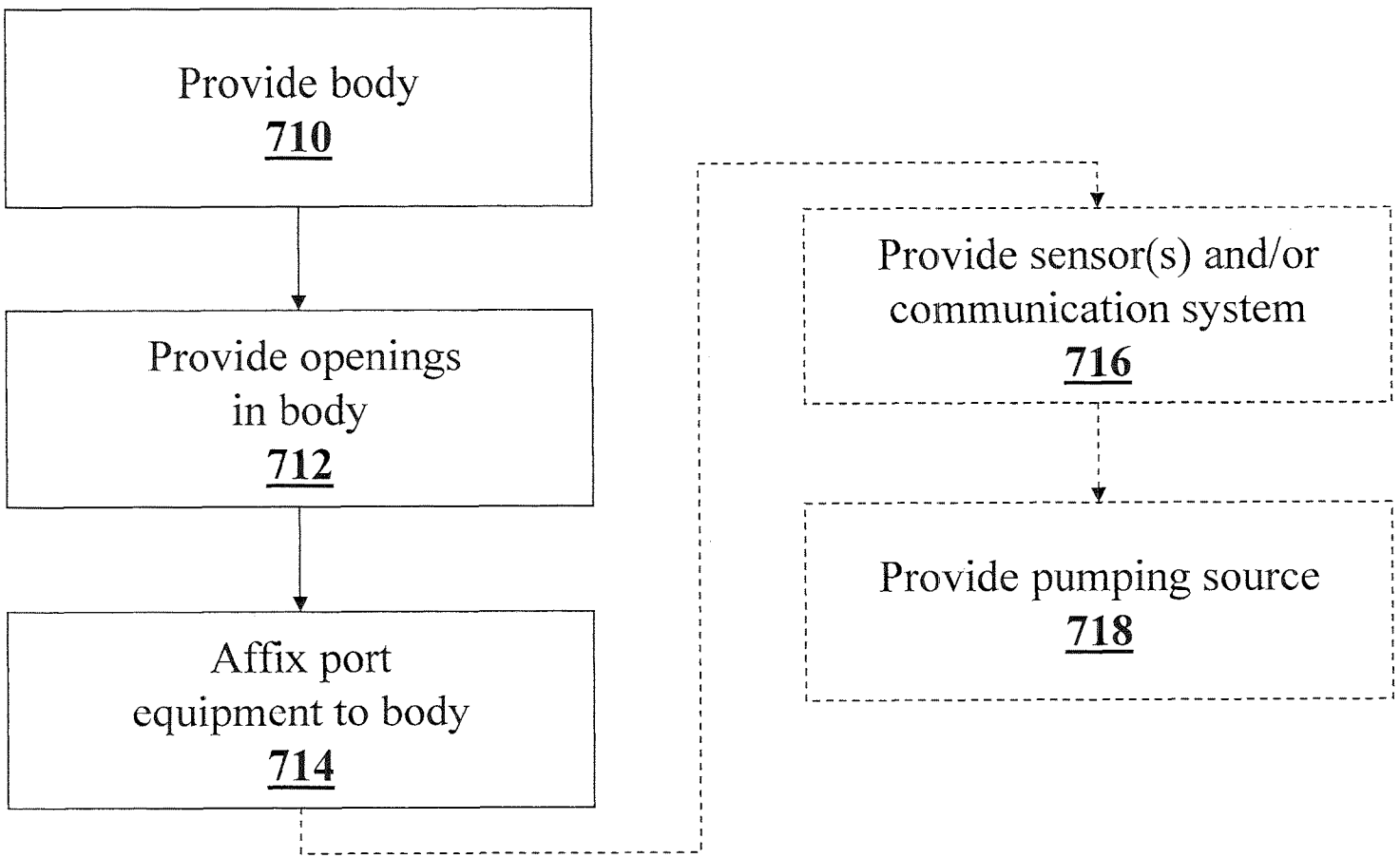
FIG. 7 is a flow chart depicting an example method for manufacturing an apparatus and system for cargo shipment security, according to embodiments of the present invention.

FIG. 7 depicts a method of manufacturing a security enclosure according to embodiments of the present invention. First, a body of suitable material and shape is provided, e.g., by manufacturing using known fabric manufacturing techniques (step 710). Openings are provided in the body, including at least a sufficient number of openings to serve as a pumping port and one or more additional sealable ports (step 712). The openings that will serve as the one or more additional sealable ports can be positioned, for example, to enable a turbulent flow to pass through a predetermined or maximized volume of an internal environment within the body in response to fluid being caused to pass through the body. Step 712 can include any suitable means for disposing openings in the material. For example, the openings can be cut into the material. In alternative embodiments, the body is manufactured in step 710 to have a particular desired shape that includes some or all of the openings. Accordingly, steps 710 and 712 can be combined and/or performed simultaneously.

Once openings are provided, port equipment can be affixed to the body (step 714). For example, one or more sealing members can be provided, such as plugging members, as well as a sealable hatch conjunction with a hinge, a handle, and a rubber flange. Additionally, port equipment can include members on the pumping port for enabling a pumping source to couple with the body at the pumping port. The pump port may include a one-way valve preventing the influx of fluid once a vacuum is applied, or preventing the release of fluid if a positive pressure is applied. Any other known port equipment can also be provided, as would be appreciated by one skilled in the art upon reading the present specification. Affixing the port equipment to the ports and/or body can include sewn or other seams, one or more layers of adhesive, fastening members, any other suitable fixation mechanism, and any combination thereof.

Optionally, sensors (e.g., pressure sensors, other environmental sensors, substance detectors) and/or a communication system (e.g., communication device, processor, memory) can be provided (step 716). If such sensors or communication system components are intended to be disposed within, through, and/or on the apparatus, they can be affixed accordingly. Optionally, a pumping source (e.g., vacuum source) can be provided, in order to enable a turbulent flow within the body and to enable an altered pressure (e.g., reduced or increased) within the body. Any of the sensors, pumping source, and security enclosure can be provided, packaged, and sold as a kit, if so desired.

Figure 8:
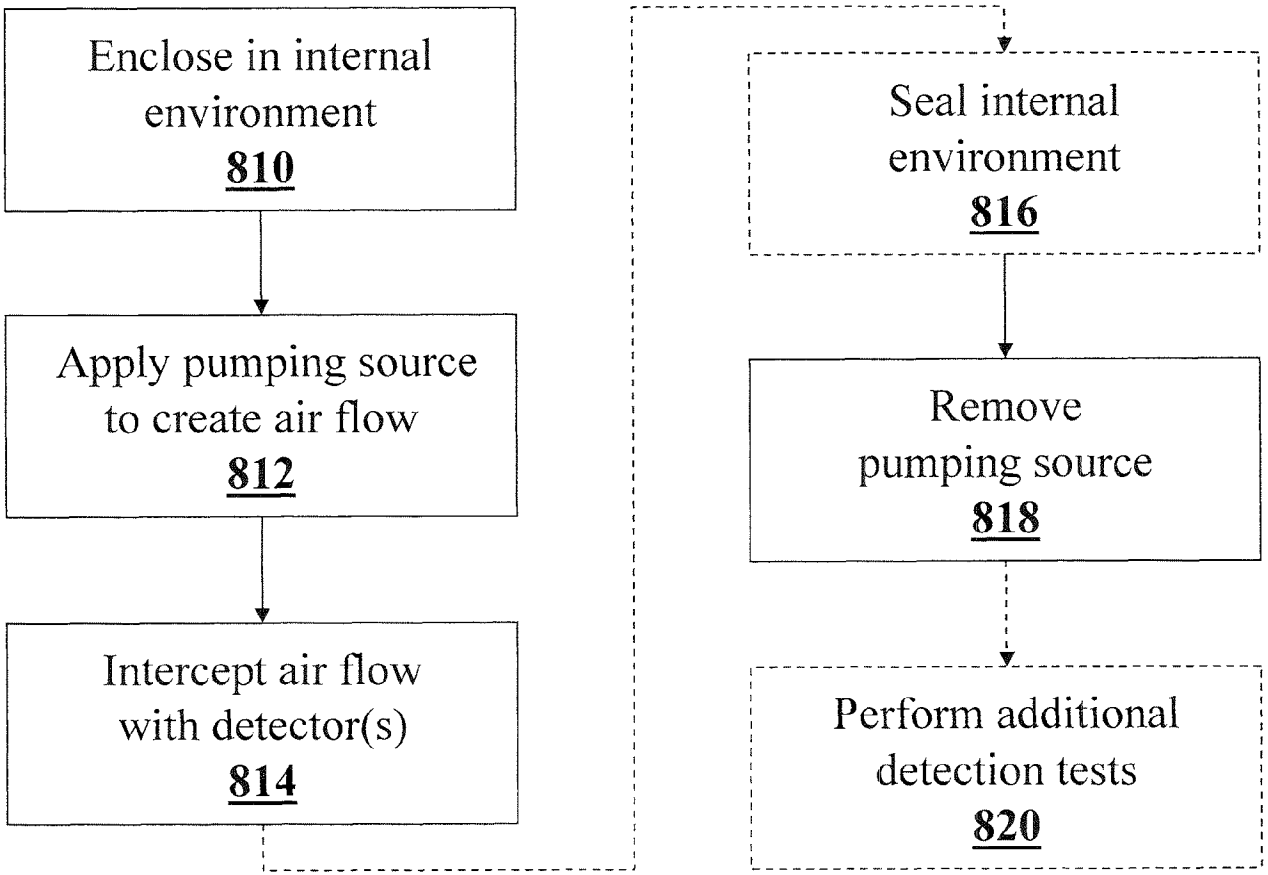
FIG. 8 is a flow chart depicting an example method for performing one or more detection tests using security enclosure and/or systems according to embodiments of the present invention.

FIG. 8 depicts an illustrative method for operating a security enclosure according to embodiments of the present invention. First, one or more contents are completely contained by and enclosed in an internal environment of the security enclosure (step 810, A pumping source, such as a vacuum source, is applied at a pumping port of the security enclosure, thereby creating a turbulent flow within the internal environment, such as an air flow (step 812). The turbulent flow is intercepted with one or more detectors and/or collectors, such as a substance detector and/or collector (step 814). The security enclosure can optionally be sealed (step 816) so as create a fluid tight seal that, in the absence of a breach, maintains an absolute pressure within the internal environment or maintains a substantially constant pressure gradient across the security enclosure. For example, step 816 can include the steps of: a) closing the one or more sealable ports, b) continuing to apply the pumping source until a predetermined pressure has been provided within the internal environment (e.g., a vacuum), and then b) closing the sealable vacuum source. Once the environment is sealed, the vacuum source can be removed (step 818).

One skilled in the art can appreciate that one or more of the steps of FIG. 8 can be performed simultaneously and/or in reverse order as shown in FIG. 8. For example, steps 816 and 818 can occur simultaneously or in reverse order, depending on the type of pumping source being applied. Additionally, steps 814 and 816 can occur simultaneously or in reverse order, for example depending on the pumping rate and the sampling quantity that is desired or necessary to perform detection tests.

In further embodiments, the one or more additional sealable ports can be initially sealed prior to applying the pumping source (step 812), such that the method of FIG. 8 additionally includes the step of unsealing the one or more additional sealable ports, prior to step 814. In such embodiments, the sealing and unsealing of the one or more additional ports can be controlled electronically and in a graduated fashion. Said differently, in some embodiments of the present invention, the one or more additional ports are configured to become unsealed in a particular predetermined sequence that controls the manner in which fluid flowing through the ports is introduced to the interior of the body 110, as would be appreciated by one skilled in the art. For example, the one or more additional ports can be initially configured to become unsealed (e.g., can be configured to automatically open) in a manner that allows a fluid to flow through a maximized volume of the internal environment.

Subsequent to step 818, one or more additional detection tests can be performed. For example, if a detection test is positive for a particular substance, then comprehensive follow up tests can be executed in more secure and/or controlled environments. Additionally, if, subsequent to step 818, inspection of the enclosure 100 or measurements of the interior environment 120 indicate equilibration with the external environment 122 (or otherwise indicate breach of the enclosure 100 due to tampering, theft, damage, etc.), additional detection tests can be performed to assess whether explosives, narcotics, or other hazardous or illicit materials may have been added to the enclosure. The additional tests can include repetitions of the above described detection tests, can be any other detection test described herein, or can be any alternative detection tests not explicitly described herein.

Figure 9:
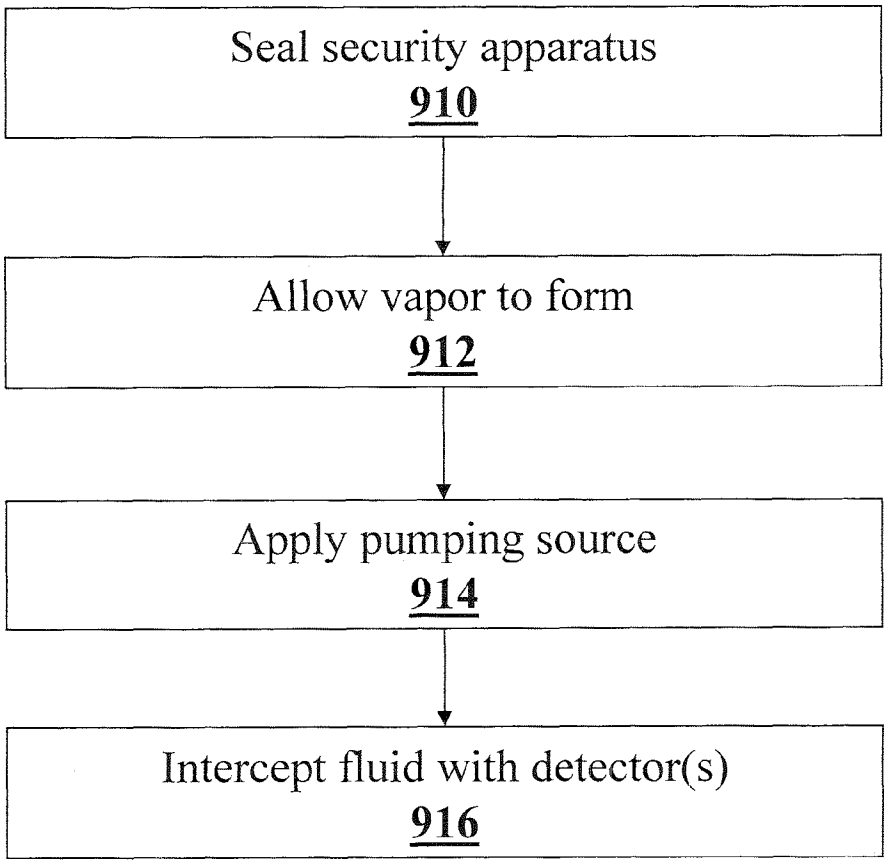
FIG. 9 is a flow chart depicting an example method for performing an additional detection test according to further embodiments of the present invention.

For example, FIG. 9 depicts an additional method for detecting the presence of a substance within a security enclosure according to example embodiments of the present invention. Subsequent to providing a fluid seal to the security enclosure (step 910), a vapor can be allowed to form within the security enclosure (step 912), for example, due to the natural vaporization of a substance when subjected to a closed internal environment, which may include any number of environment conditions for promoting the formation of a vapor, including as examples a reduced pressure, an increased temperature, a complete lack of or nearly complete lack of ventilation with the external environment 122, or any combination thereof. One skilled in the art can appreciate that other environmental circumstances can be applied to the internal environment 120 in order to promote the formation of a vapor. If so desired, the pressure of the internal environment can be lowered in a manner so as to expedite the vaporization of particular particles or substances. Step 912 can include providing a sufficient time for a vapor to form. Once a vapor has formed, a pumping source can be applied to the security enclosure at the pumping port (step 914). In the illustrative method of FIG. 9, the one or more additional sealed ports remain sealed during step 914. In alternative embodiments, the one or more additional sealed ports can be unsealed. In response to the pumping source, fluid is caused to intercept one or more substance detectors and/or collectors for detecting the presence of a substance (step 916).

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A cargo shipment security system, comprising:

a flexible body configured to completely enclose and contain cargo within an internal environment and maintain a predetermined pressure within the internal environment;

a sealable vacuum port disposed on and through the body and configured to couple with a vacuum source for creating a vacuum within the internal environment;

one or more sealable ports disposed on and through the body, positioned to cause a turbulent flow through a predetermined volume of the internal environment of the body when the vacuum source is applied at the vacuum port and fluid is caused to enter the internal environment through the one or more sealable ports; and one or more substance detectors, one or more substance collectors, or both positioned to intercept fluid flowing from the internal environment to an external environment outside the body, in such a way as to enable detection of the presence of a substance exiting from the internal environment;

wherein the turbulent flow is sufficient to dislodge at least a trace amount of the substance.

2. The system of claim 1, wherein the predetermined pressure is a predetermined absolute pressure that is not equal to a pressure of the external environment.

3. The system of claim 1, wherein the predetermined pressure is a predetermined differential pressure with respect to the external environment.

4. The system of claim 1, wherein the one or more substance detectors, one or more substance collectors, or both, comprise a substance collector, and wherein the system further comprises an ion mobility spectrometer device.

5. The system of claim 1, wherein the predetermined pressure is a pressure of at least about 50 mm Hg less than a lowest expected atmospheric pressure to be encountered during an instance of vulnerability to tampering, theft, or damage once prepared for conveyance or while in transit.

6. The system of claim 1, wherein the predetermined pressure is a pressure of about 500 mm Hg or less.

7. The system of claim 1, wherein the vacuum port and the one or more sealable ports are configured to be reopened and resealed, thereby enabling one or more detection tests to be performed on a single cargo shipment.

8. The system of claim 1, wherein the body further comprises an airtight zipper for enclosing and sealing the cargo.

9. The system of claim 1, wherein the body comprises one or more materials that are impermeable to a gas, a liquid, or both.

10. The system of claim 1, wherein the body comprises a single continuous piece of material.

11. The system of claim 1, wherein the body comprises two or more pieces of material coupled together.

12. A method of manufacturing a cargo shipment security system, comprising:

providing a flexible body configured to completely enclose and contain cargo within an internal environment and maintain a predetermined pressure within the internal environment;

providing a sealable vacuum port disposed on and through the body and configured to couple with a vacuum source for creating a vacuum within the internal environment;

providing one or more sealable ports disposed on and through the body, positioned to cause a turbulent flow through a predetermined volume of the internal environment of the body when the vacuum source is applied at the vacuum port and fluid is caused to enter the internal environment through the one or more sealable ports; and providing one or more substance detectors, one or more substance collectors, or both, configured to intercept fluid flowing from the internal environment to an external environment outside the body, in such a way as to enable detection of the presence of a substance exiting from the internal environment;

wherein the turbulent flow is sufficient to dislodge at least a trace amount of the substance.

13. The method of claim 12, wherein the predetermined pressure is a predetermined absolute pressure that is not equal to a pressure of the external environment.

14. The method of claim 12, wherein the predetermined pressure is a predetermined differential pressure with respect to the external environment.

15. The method of claim 12, wherein the one or more substance detectors, one or more substance collectors, or both, comprise a substance collector, wherein the method further comprises providing an ion mobility spectrometer device.

16. The method of claim 12, wherein the predetermined pressure is a pressure of at least about 50 mm Hg less than a lowest expected atmospheric pressure to be encountered during an instance of vulnerability to tampering, theft, or damage once prepared for conveyance or while in transit.

17. The method of claim 12, wherein the predetermined pressure is a pressure of about 500 mm Hg or less.

18. The method of claim 12, wherein the vacuum port and the one or more sealable ports are configured to be reopened and resealed, thereby enabling one or more detection tests to be performed on a single cargo shipment.

19. The method of claim 12, wherein the body further comprises an airtight zipper for enclosing and sealing the cargo.

20. The method of claim 12, wherein the body comprises one or more materials that are impermeable to a gas, a liquid, or both.

21. The method of claim 12, wherein the body comprises a single continuous piece of material.

22. The method of claim 12, wherein the body comprises two or more pieces of material coupled together.

23. A cargo shipment security method, the method comprising:

completely enclosing cargo within an internal environment of an apparatus, the apparatus comprising a flexible body having a sealable vacuum port and one or more sealable ports;

applying a vacuum source at the vacuum port, thereby causing fluid to enter the internal environment through the one or more sealable ports and causing turbulent flow through a predetermined volume of the internal environment;

providing one or more substance detectors, one or more substance collectors, or both, positioned to intercept fluid flowing from the internal environment to an external environment that is outside of the body, in such a way as to enable detection of the presence of a substance exiting from the internal environment;

sealing the one or more sealable ports; and removing the vacuum source and sealing the vacuum port, thereby completely sealing the body;

wherein the completely sealed body maintains a predetermined absolute or differential pressure within the internal environment.

24. The method of claim 23, further comprising:

providing sufficient time for a vapor to form within the internal environment of the completely sealed body;

opening the vacuum port and applying the vacuum source at the vacuum port, thereby causing fluid including at least a portion of the vapor to exit from the internal environment; and using the one or more substance detectors, one or more substance collectors, or both, to detect the presence of the substance within the vapor.

25. The method of claim 23, further comprising providing one or more pressure sensors for detecting at least a predetermined minimum amount or rate of pressure change in the pressure of the internal environment.

26. The method of claim 23, further comprising:

providing one or more pressure sensors for detecting at least a predetermined minimum amount or rate of pressure change in the pressure of the internal environment;

detecting at least the predetermined minimum amount or rate of pressure change in the pressure of the internal environment.

27. The method of claim 23, further comprising:

providing one or more pressure sensors for detecting at least a predetermined minimum amount or rate of change in the pressure of the internal environment;

detecting at least the predetermined minimum amount or rate of change in the pressure of the internal environment; and transmitting the detection that at least the predetermined minimum amount or rate of change in the pressure of the internal environment to a position outside of the internal environment.

28. The method of claim 23, further comprising performing one or more additional trace detection tests for the substance subsequent to sealing the one or more sealable ports.

29. A cargo shipment security kit, comprising:

an apparatus, comprising:

a flexible body configured to completely enclose and contain cargo within an internal environment and maintain a predetermined pressure within the internal environment;

a sealable vacuum port disposed on and through the body and configured to couple with a vacuum source for creating a vacuum within the internal environment; and one or more sealable ports disposed on and through the body, positioned to cause a turbulent flow through a predetermined volume of the internal environment of the body when the vacuum source is applied at the vacuum port and fluid is caused to enter the internal environment through the one or more sealable ports;

wherein the turbulent flow is sufficient to dislodge at least a trace amount of a substance; and one or more substance detectors, one or more substance collectors, or both, configured to be positioned in such a way as to intercept fluid flowing from the internal environment to an external environment outside the body enable detection of the presence of the substance exiting from the internal environment.

30. The kit according to claim 29, further comprising the vacuum source.

31. The kit according to claim 29, further comprising an ion mobility spectrometer device.

* * * * *